US009966214B2

(12) United States Patent
Kubono

(10) Patent No.: US 9,966,214 B2
(45) Date of Patent: May 8, 2018

(54) ELECTROMAGNETIC RELAY

(71) Applicant: FUJITSU COMPONENT LIMITED, Tokyo (JP)

(72) Inventor: Kazuo Kubono, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days. days.

(21) Appl. No.: 15/307,086

(22) PCT Filed: Jun. 22, 2015

(86) PCT No.: PCT/JP2015/067861
§ 371 (c)(1),
(2) Date: Oct. 27, 2016

(87) PCT Pub. No.: WO2016/002558
PCT Pub. Date: Jan. 7, 2016

(65) Prior Publication Data

US 2017/0047182 A1 Feb. 16, 2017

(30) Foreign Application Priority Data

Jul. 3, 2014 (JP) ..... 2014-138119

(51) Int. Cl.
*H01H 51/22* (2006.01)
*H01H 50/24* (2006.01)
(Continued)

(52) U.S. Cl.
CPC ..... *H01H 50/24* (2013.01); *H01H 50/04* (2013.01); *H01H 50/14* (2013.01); *H01H 50/36* (2013.01); *H01H 50/44* (2013.01); *H01H 50/56* (2013.01)

(58) Field of Classification Search
CPC ..... H01H 50/14; H01H 50/02; H01H 50/22; H01H 50/24; H01H 50/28; H01H 50/36;
(Continued)

(56) References Cited

U.S. PATENT DOCUMENTS 3,017,474 A * 1/1962 Huetten ..... H01H 50/20 335/179
5,239,281 A * 8/1993 Tomono ..... H01H 50/042 335/128
(Continued)

FOREIGN PATENT DOCUMENTS

JP S58-047633 U 10/1983
JP H07-254340 10/1995
(Continued)

*Primary Examiner* — Shawki S Ismail
*Assistant Examiner* — Lisa Homza
(74) *Attorney, Agent, or Firm* — IPUSA, PLLC

(57) ABSTRACT

An electromagnetic relay includes a spool in which a coil is wound around its outer peripheral surface, and a magnetic core is inserted in its inside; a yoke arranged along the spool; and an insulating member provided between a first member including the coil, and second members including a fixed contact portion, a movable contact portion, an armature and the yoke to contribute to insulation between the first member and the second members, wherein the insulating member is provided with an opening portion at a portion that does not face the second members, and the spool is inserted in the insulating member from the opening portion to be placed in the insulating member.

6 Claims, 7 Drawing Sheets

(51) Int. Cl.

| | |
|---|---|
| ***H01H 50/04*** | (2006.01) |
| ***H01H 50/44*** | (2006.01) |
| ***H01H 50/14*** | (2006.01) |
| ***H01H 50/36*** | (2006.01) |
| ***H01H 50/56*** | (2006.01) |

(58) Field of Classification Search
CPC ..... H01H 50/38; H01H 50/54; H01H 50/56; H01H 50/58; H01H 50/60; H01H 1/06; H01H 33/182
USPC ..... 335/78
See application file for complete search history.

(56) References Cited

U.S. PATENT DOCUMENTS 5,757,255 A 5/1998 Noda et al.
6,211,761 B1 4/2001 Yoshino et al.
8,164,404 B2 * 4/2012 Kamiya ..... H01H 9/04 218/157
8,493,164 B2 * 7/2013 Kurihara ..... H01H 50/047 335/78
2002/0036556 A1 * 3/2002 Matsuda ..... H01H 50/12 335/78
2005/0046527 A1 * 3/2005 Chida ..... H01H 50/002 335/78
2005/0057332 A1 * 3/2005 Nakamura ..... H01H 50/042 335/128
2008/0180197 A1 * 7/2008 Kubono ..... H01H 50/043 335/78
2010/0117769 A1 * 5/2010 Kuo ..... H01H 50/026 335/78
2013/0257566 A1 * 10/2013 Li ..... H01H 51/22 335/127
2014/0159837 A1 * 6/2014 Hiraiwa ..... H01H 9/443 335/201
2015/0048909 A1 * 2/2015 Heinrich ..... H01H 50/041 335/85

FOREIGN PATENT DOCUMENTS

JP H11-096876 4/1999
JP H11-111143 4/1999
JP 2009-009710 1/2009

* cited by examiner

ELECTROMAGNETIC RELAY

FIELD

The present invention relates to an electromagnetic relay.

BACKGROUND

Electromagnetic relays in which a contact is opened and closed in accordance with an input of an electric signal are conventionally widely provided. Generally, the electromagnetic relays include a fixed contact portion, a movable contact portion that contacts the fixed contact portion, and an electromagnetic device that operates the movable contact portion.

The electromagnetic device is provided with a spool around which a coil is wound. The electromagnetic relay includes an insulating structure in order to prevent the coil of the electromagnetic device from electrically connected to the fixed contact portion or the movable contact portion.

PATENT DOCUMENTS

Patent Document 1: Japanese Laid-open Patent Publication No. H11-96876

Patent Document 2: Japanese Laid-open Patent Publication No. H7-254340

Patent Document 3: Japanese Laid-open Patent Publication No. H11-111143

As an insulating effect of the insulating structure differs based on the arrangement, the shape or the like of an insulating member, it is important for the electromagnetic relay to form the insulating member in accordance with each of the structures. Meanwhile, if the insulating structure is complicated, that influences the fabrication of the electromagnetic relay. Thus, it is necessary to provide an insulating structure capable of fabricating easily.

SUMMARY

Thus, it is desirable to provide an electromagnetic relay including an insulating structure for which the fabrication is easy with a high insulating effect.

According to one embodiment, there is provided an electromagnetic relay including a fixed contact portion that includes a fixed contact; a movable contact portion that includes a movable contact that contacts the fixed contact; an armature that is connected to the movable contact portion, and is operated to rotate to move the movable contact portion between a contacting position at which the fixed contact and the movable contact contact, and a non-contacting position at which the fixed contact and the movable contact are apart from each other; a spool in which a coil is wound around its outer peripheral surface, and a magnetic core is inserted in its inside; a yoke arranged along the spool; and an insulating member provided between a first member including the coil, and second members including the fixed contact portion, the movable contact portion, the armature and the yoke to contribute to insulation between the first member and the second members, wherein the insulating member is provided with an opening portion at a portion that does not face the second members, and the spool is inserted in the insulating member from the opening portion to be attached to the insulating member.

According to at least one embodiment, it is possible to provide an electromagnetic relay including an insulating structure for which the fabrication is easy with a high insulating effect.

DESCRIPTION OF EMBODIMENTS

Figure 1:
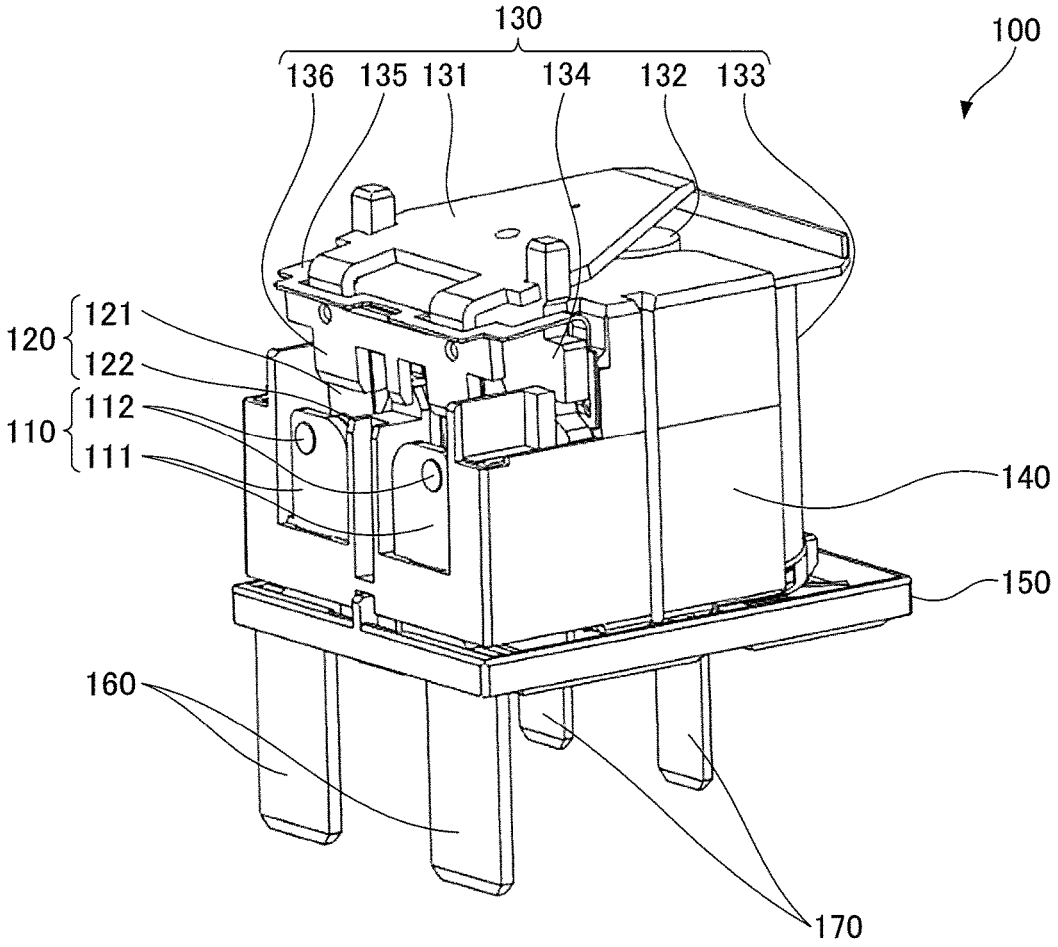
FIG. 1 is a view illustrating an overall structure of an electromagnetic relay.

The invention will be described herein with reference to illustrative embodiments. It is to be noted that, in the explanation of the drawings, the same components are given the same reference numerals, and explanations are not repeated.

First Embodiment (1. Overall Structure of Electromagnetic Relay)

First, the overall structure of an electromagnetic relay of the embodiment is described. FIG. 1 is a view illustrating the overall structure of the electromagnetic relay under a state in which an outer cover is removed.

As illustrated in FIG. 1, an electromagnetic relay 100 includes a fixed contact portion 110, a movable contact portion 120 and an electromagnetic device 130. The fixed contact portion 110, the movable contact portion 120 and the electromagnetic device 130 are fixed by a base mold 140 and a bottom plate 150. Two terminals 160 and two terminals 170 protrude at a lower side of the bottom plate 150.

The fixed contact portion 110 includes two fixed contact springs 111 and two fixed contacts 112, and the fixed contact springs 111 are connected to the different terminals 160, respectively. Similarly, the movable contact portion 120 includes two movable contact springs and two movable contacts, that face the corresponding fixed contact springs 111 and the corresponding fixed contacts 112, respectively. The two movable contact springs are connected to an armature 131 via a holding member 136. Here, in FIG. 1, only one of the movable contact springs 121, among the two movable contact springs, and one of the movable contact 122, among the two movable contacts, are illustrated.

The electromagnetic device 130 includes the armature 131, a magnetic core 132, a coil 133, a yoke (soft iron) 134, a hinge spring 135 and the holding member 136.

The armature 131 is configured to be operated to rotate around an upper end portion of the yoke 134 as a fulcrum. When the armature 131 is operated to rotate around the upper end portion of the yoke 134 as a fulcrum, the movable contact portion 120 connected to the armature 131 via the holding member 136 is operated to reciprocate between a contacting position at which the movable contacts and the fixed contacts contact, and a non-contacting position at which the movable contacts and the fixed contacts do not contact.

The armature 131 adsorbs to and moves away from an end surface (a magnetic core surface) of the magnetic core 132. Specifically, when electromagnetic force is generated due to voltage applied to the terminals 170 connected to the coil 133, the armature 131 is adsorbs to the magnetic core surface. As a result, the movable contact portion 120 moves to the contacting position. Here, when the movable contact portion 120 moves to the contacting position, one of the terminals 160 is electrically connected to the other of the terminals 160 via one of the fixed contacts and movable contacts, the holding member and the other of the movable contacts and fixed contacts.

The hinge spring 135 pushes the armature 131 in a direction that the armature 131 moves away from the magnetic core surface. As the hinge spring 135 always pushes the armature 131 in a direction in which the armature 131 moves away from the magnetic core surface, if the application of the voltage to the terminals 170 is terminated, the armature 131 departs from the magnetic core surface and the movable contact portion 120 moves to the non-contacting position. Then, the movable contact portion 120 is maintained at the non-contacting position until the voltage is applied to the terminals 170 next.

(2. Description of Insulating Structure Included in Electromagnetic Relay)

Figure 2:
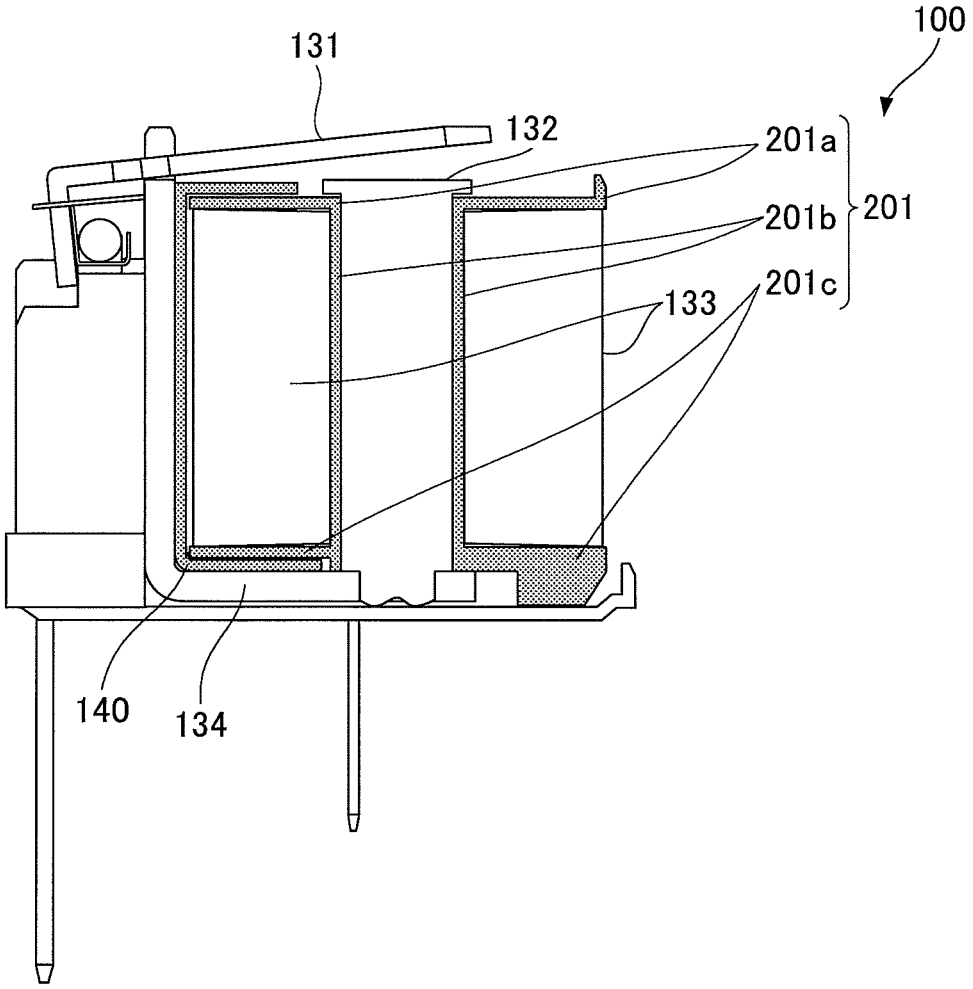
FIG. 2 is a cross-sectional view for describing an insulating structure included in the electromagnetic relay.

Next, the insulating structure included in the electromagnetic relay 100 is described. FIG. 2 is a cross-sectional view for describing the insulating structure included in the electromagnetic relay 100, and illustrates an internal structure of the electromagnetic relay 100 (the fixed contact portion 110, the movable contact portion 120 and the like are not illustrated). As illustrated in FIG. 2, the magnetic core 132 is inserted in a hollow column portion 201*b* that is formed at a center position of a spool 201 formed by an insulating material. The coil 133 is wound around an outer peripheral surface of the column portion 201*b*. Disc-like shaped members 201*a* and 201*c* are provided around openings of the column portion 201*b* at an upper end and a lower end of the column portion 201*b* of the spool 201. With the above structure, the spool 201 contributes to an insulation between the coil 133 and the magnetic core 132.

The base mold 140 is formed by an insulating material such as resin, and the spool 201 is attached inside the base mold 140. The armature 131 is placed along a side surface and an upper surface of the spool 201 while sandwiching the base mold 140 between the armature 131 and the spool 201. The yoke 134 is placed along the side surface and a bottom surface of the spool 201 while sandwiching the base mold 140 between the yoke 134 and the spool 201, and has an L shape.

As the spool 201 is attached inside the base mold 140, and the base mold 140 is sandwiched between the coil 133 and the armature 131, the armature 131 is insulated from the coil 133 by the disc-like shaped member 201*a* of the spool 201 and the base mold 140. Further, as the spool 201 is attached inside the base mold 140, and the base mold 140 is sandwiched between the coil 133 and the yoke 134, the yoke 134 is insulated from the coil 133 by the disc-like shaped member 201*c* of the spool 201 and the base mold 140.

Further, the fixed contact portion 110, the movable contact portion 120 and the like are provided at opposite (left of the yoke 134 in FIG. 2) of the coil 133 with respect to the yoke 134. By providing the fixed contact portion 110 and the movable contact portion 120 at opposite of the coil 133 with respect to the yoke 134, the fixed contact portion 110 and the movable contact portion 120 are also insulated from the coil 133 by the base mold 140.

As such, the base mold 140 contributes to the insulation of the coil 133 between the yoke 134, the armature 131, the movable contact portion 120, the fixed contact portion 110 (not illustrated in FIG. 2) and the like, with the disc-like shaped members 201*a* and 201*c* of the spool 201.

(3. Arrangement and Shape of Insulating Member)

Figure 3:
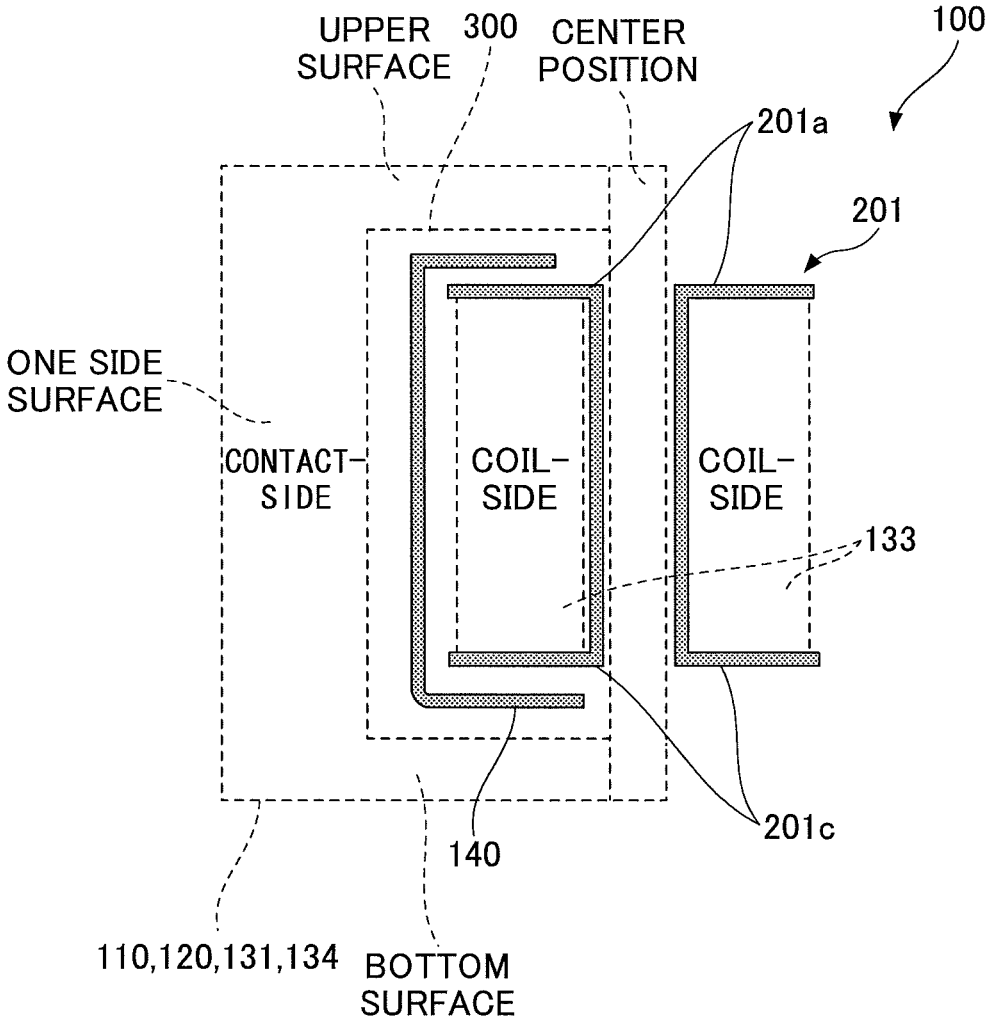
FIG. 3 is a view schematically illustrating the insulating structure included in the electromagnetic relay.

Next, the arrangement and the shape of the insulating member (base mold 140, spool 201) in the electromagnetic relay 100 are further described in detail. FIG. 3 is a view for describing the arrangement and the shape of the insulating member of the electromagnetic relay 100, and schematically illustrates the insulating structure included in the electromagnetic relay 100.

As illustrated in FIG. 3, members that constitute the electromagnetic relay 100 are largely divided into contact-side members and a coil-side member, for explanation purposes. Here, in the electromagnetic relay 100 of the embodiment, the contact-side members include the fixed contact portion 110, the movable contact portion 120, the armature 131, the yoke 134 and the magnetic core 132. Meanwhile, the coil-side member includes the coil 133. FIG. 3 schematically illustrates positions where the contact-side members are arranged.

In the electromagnetic relay 100 of the embodiment, the contact-side members are arranged at an upper surface, one side surface, a bottom surface and a center position of the spool 201. Among them, the magnetic core 132, which is the contact-side member that is arranged at the center position of the spool 201, is insulated from the coil-side member by the disc-like shaped members 201*a* and 201*c* and the column portion 201*b* of the spool 201.

Meanwhile, in order to insulate the contact-side members that are arranged at the upper surface, the one side surface and the bottom surface of the spool 201 from the coil-side member, it is effective to provide the insulating member between the contact-side members and the coil-side member to cover the upper surface, the one side surface and the bottom surface of the spool 201 by the insulating member.

Thus, according to the electromagnetic relay 100 of the embodiment, a structure is adopted in which the upper surface, the one side surface (specifically, a side surface portion that faces the yoke 134) and the bottom surface of the spool 201 are covered by the base mold 140 having a U-shape in a cross-sectional view.

(4. Shape of Base Mold and Method of Attaching Spool)

Figure 4:
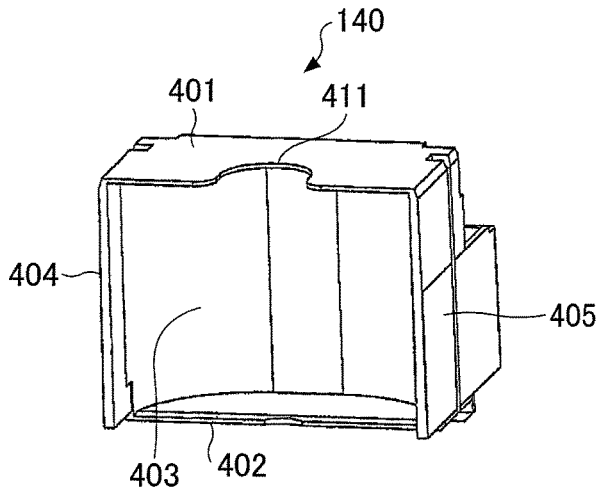
FIG. 4 is a view illustrating an appearance of a base mold.

Next, the shape of the base mold 140 and the method of attaching the spool 201 are described. FIG. 4 is a view illustrating an appearance of the base mold 140.

As illustrated in FIG. 4, the base mold 140 includes an upper end surface 401, a lower end surface 402, a back surface 403, a right side surface 404 and a left side surface 405, and is provided with an opening portion. The opening portion is provided at a portion of each of the surfaces of the base mold 140 that does not face the contact-side members. The upper end surface 401, the lower end surface 402, the back surface 403, the right side surface 404 and the left side surface 405 function as wall surfaces that exist between the coil-side member (coil 133) and the contact-side members (the fixed contact portion 110, the movable contact portion 120, the yoke 134, the armature 131 and the like). An arc-shaped cutout 411 is formed at the upper end surface 401, and the magnetic core surface of the magnetic core 132 is attached at a position of the cutout 411.

Figure 5:
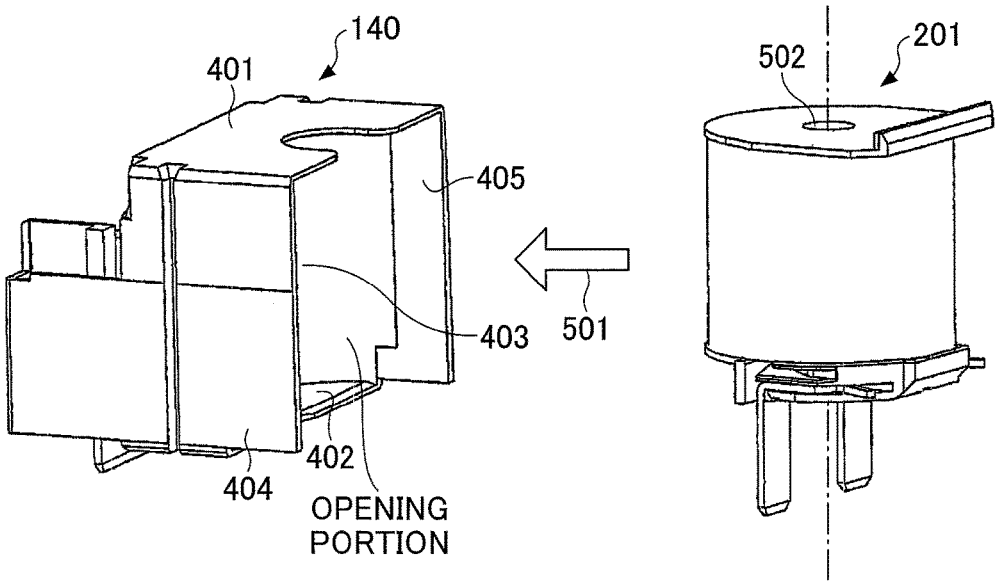
FIG. 5 is a view illustrating an insertion direction of a spool to the base mold.

FIG. 5 is a view for describing a method of attaching the spool 201 to the base mold 140, and illustrates an insertion direction of the spool 201 to the base mold 140. As illustrated in FIG. 5, according the embodiment, the spool 201 is inserted, with respect to the opening portion of the base mold 140, in a direction (direction of an arrow 501) that is substantially perpendicular to a longitudinal axis direction (direction of a chain line) of the opening 502 in which the magnetic core 132 is inserted, and is attached in the base mold 140.

As such, the opening portion of the base mold 140 is used as an attaching port of the spool 201 to the base mold 140. As the contact-side members are not arranged in the vicinity of the opening portion, it is considered that the insulation between the contact-side members and the coil-side member are retained even when the opening portion is not covered by the base mold 140, which is the insulating member. Further, by using the opening portion as the attaching port, the fabrication such as the attachment of the spool 201 to the base mold 140 or the like can be made easy while actualizing a high insulating effect.

(5. Cover that Covers Contact-Side Members)

As already described with reference to FIG. 3, a structure is adopted in which the coil-side member is covered by the base mold 140 in the electromagnetic relay 100 of the embodiment. Thus, the contact-side members are arranged at outside the base mold 140, and the upper surface of the armature 131 and the bottom surface of the yoke 134 having an L-shape are exposed outside.

As described above with reference to FIG. 5, for the electromagnetic relay 100 of the embodiment, among the coil-side member, a portion that faces the contact-side members is covered by the insulating member while the opening portion is provided at a portion that does not face the contact-side member. The coil-side member is not covered by the insulating member at the portion at which the opening portion is provided. Thus, among the coil-side member, the portion that does not face the contact-side members is exposed outside. Therefore, for the electromagnetic relay 100 of the embodiment, the outer cover and the bottom plate are provided.

Figure 6:
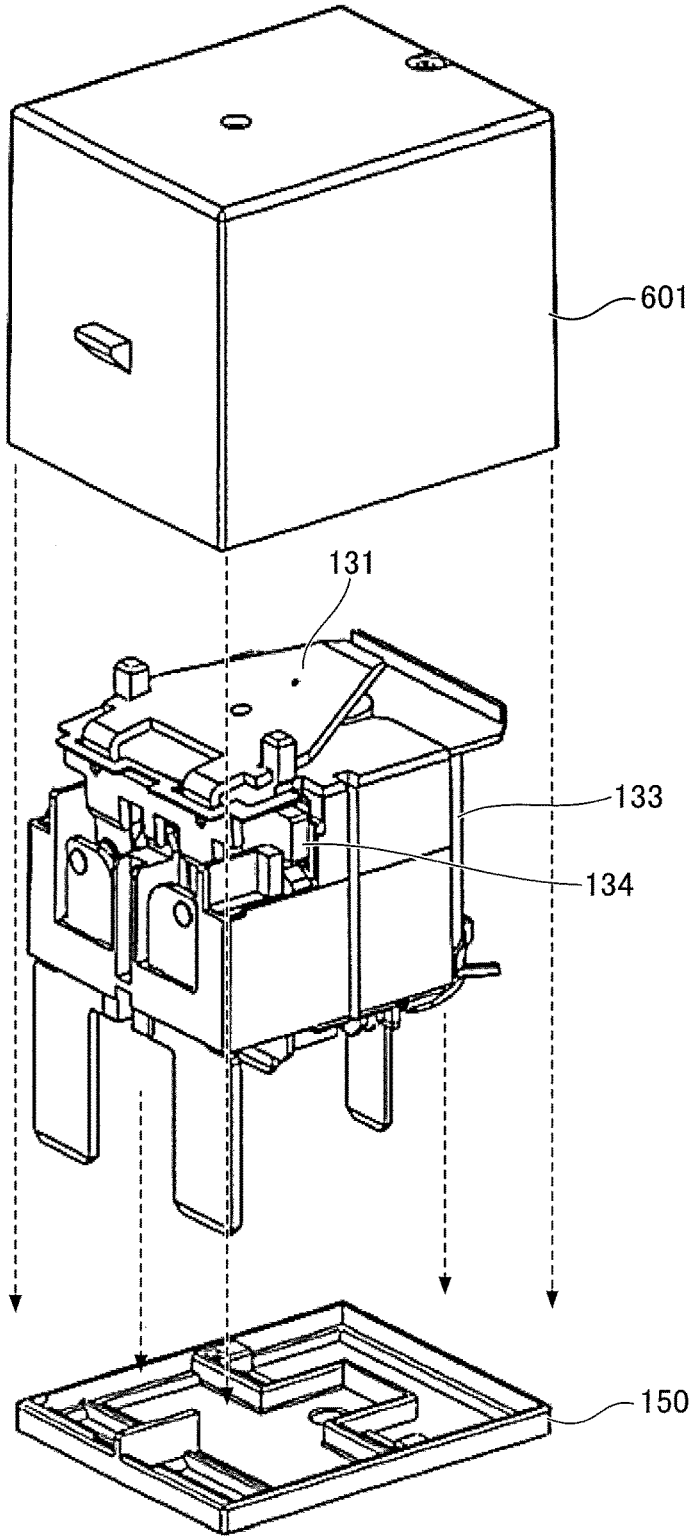
FIG. 6 is a view illustrating an outer cover and a bottom plate of the electromagnetic relay.

FIG. 6 is a view illustrating the outer cover 601 and the bottom plate 150 of the electromagnetic relay 100. As illustrated in FIG. 6, by providing the outer cover 601 and the bottom plate 150, the bottom surface of the armature 131 or the yoke 134 and a part of the coil 133 are prevented from being exposed outside.

(6. Summary)

As is apparent from the above description, according to the electromagnetic relay of the embodiment,

- a structure is adopted in which the insulation between the coil-side member and the contact-side members is actualized by the base mold arranged between the coil-side member and the contact-side members and the spool,
- a structure is adopted in which the insulating member is arranged at portions for which the insulation between the coil-side member and the contact-side members is necessary (portions, among the coil-side member, that face the contact-side members),
- as it is unnecessary to arrange the insulating member at portions, among the coil-side member, that do not face the contact-side members, an opening portion for attaching the spool to the base mold is formed at the position of the base mold 140, and
- a structure is adopted in which the outer cover and the bottom plate are provided such that the coil at the opening portion side, the yoke and the armature do not contact the outside.

As such, by setting the arrangement and the shape of the insulating member to correspond to the arrangement of the contact-side members and the arrangement of the coil-side member, a high insulating effect can be obtained. Further, by using the opening portion provided at the portion that does not influence to the insulating effect, the spool can be easily attached. In other words, it is possible to provide an electromagnetic relay for which the fabrication is easy with a high insulating effect.

Here, the base mold 140 and the spool 201 may be fixed by a method of fixing with a higher insulating effect, for example.

Figure 7A:
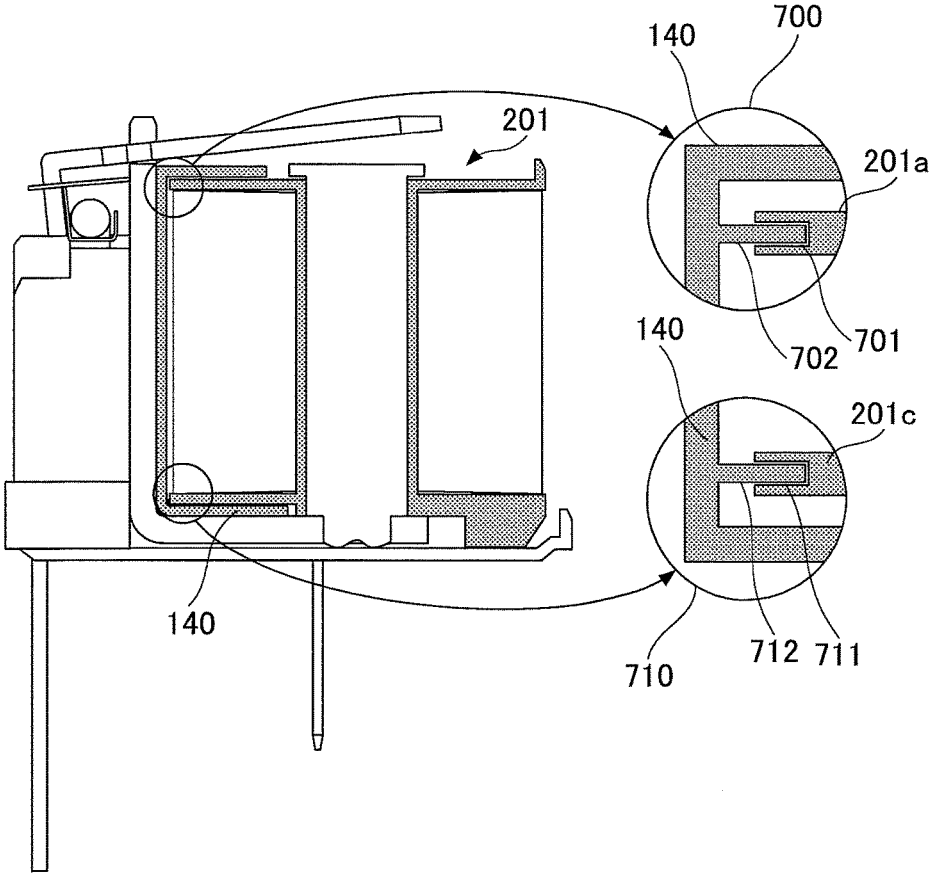
FIG. 7A is a view for describing a method of fixing the base mold and the spool.
Figure 7B:
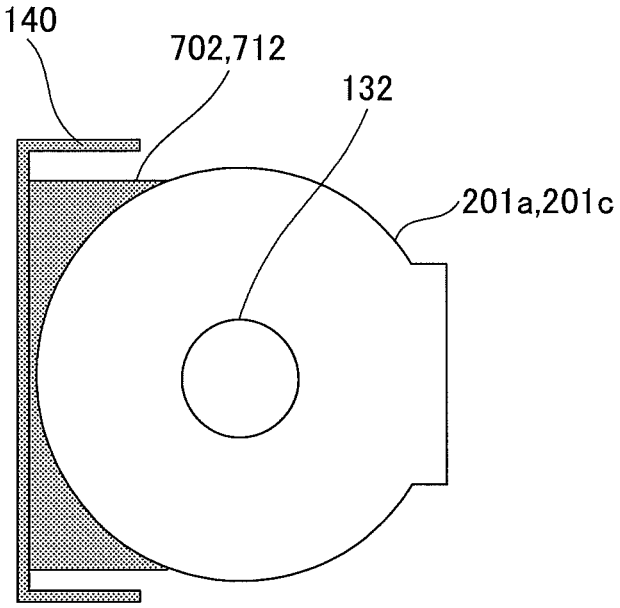
FIG. 7B is a view for describing the method of fixing the base mold and the spool.

FIGS. 7A and 7B are views for describing a method of fixing the base mold 140 and the spool 201 of the electromagnetic relay 100 of the embodiment. As illustrated in an enlarged area 700 of FIG. 7A, the disc-like shaped member 201*a* of the spool 201 is provided with a groove 701 at its outer peripheral in a circumferential direction. Further, the base mold 140 is provided with a protrusion 702 at its inner peripheral, and an arc-shaped front end of the protrusion 702 is configured to fit the groove 701 when the spool 201 is attached to the base mold 140.

Similarly, as illustrated in an enlarged area 710 of FIG. 7A, the disc-like shaped member 201*c* of the spool 201 is provided with a groove 711 at its outer peripheral in a circumferential direction. Further, the base mold 140 is provided with a protrusion 712 at its inner peripheral, and an arc-shaped front end of the protrusion 712 is configured to fit the groove 711 when the spool 201 is attached to the base mold 140.

Further, as illustrated in a plan view of FIG. 7B, as the shape of the front end of each of the protrusions 702 and 712 corresponds to the outer peripheral of each of the disc-like shaped members 201*a* and 201*c* of the spool 201, there is no space between the disc-like shaped members 201*a* and 201*c* of the and the base mold 140.

As such, when attaching the spool 201 to the base mold 140, by fixing the disc-like shaped members 201*a* and 201*c* of the spool 201 and the base mold 140 without a space, insulating properties can be further improved.

Although the structure is adopted in the above embodiment in which the grooves 701 and 711 are provided at the disc-like shaped members 201*a* and 201*c*, respectively, and the protrusions 702 and 712 are provided at the corresponding positions in the base mold 140, a structure may be adopted in which only one of the grooves and the protrusions are provided.

A structure may be adopted in which an adhesive agent is coated on a member (a bottom surface of the L-shaped yoke 134) that is arranged at a lowest surface among the contact-side members, and then the bottom plate 150 is provided. By coating the adhesive agent, it is possible to improve insulating properties between the member (the L-shaped yoke 134) that is arranged at the lowest surface and outside. Here, the bottom surface of the magnetic core is attached to the bottom surface of the yoke 134 by caulking.

The present invention is not limited to the specifically disclosed embodiments, and numerous variations and modifications may be made without departing from the spirit and scope of the present invention.

The present application is based on and claims the benefit of priority of Japanese Priority Application No. 2014-

138119 filed on Jul. 3, 2014, the entire contents of which are hereby incorporated by reference.

NUMERALS

100: electromagnetic relay
110: fixed contact portion
111: fixed contact spring
112: fixed contact
120: movable contact portion
121: movable contact spring
122: movable contact
130: electromagnetic device
131: armature
132: magnetic core
133: coil
134: yoke
135: hinge spring
136: holding member
140: base mold
150: bottom plate
160: terminal
170: terminal
201: spool
201*a*: disc-like shaped member
201*b*: column portion
201*c*: disc-like shaped member
401: upper end surface
402: lower end surface
403: back surface
404: right side surface
405: left side surface
601: outer cover
701, 711: groove
702, 712: protrusion

What is claimed is:

1. An electromagnetic relay comprising:
a fixed contact portion that includes a fixed contact;
a movable contact portion that includes a movable contact that contacts the fixed contact;
an armature that is connected to the movable contact portion, and is operated to rotate to move the movable contact portion between a contacting position at which the fixed contact contacts the movable contact, and a non-contacting position at which the fixed contact and the movable contact are apart from each other;
a spool in which a coil is wound around its outer peripheral surface, and a magnetic core is inserted in its inside;
a yoke arranged along the spool; and
an insulating member provided between a first member including the coil, and second members including the fixed contact portion, the movable contact portion, the armature and the yoke to contribute to insulation between the first member and the second members,
wherein the insulating member is provided with an opening portion at a portion that does not face any of the second members so that the spool is capable of being inserted in the insulating member from the opening portion to be placed in the insulating member,
wherein the insulating member includes a base mold including
a back surface,
a right side surface and a left side surface provided at both sides of the back surface, respectively, and
an upper end surface and a lower end surface provided at an upper end and a lower end of the back surface, respectively,
wherein the open portion is provided to be surrounded by the right side surface, the upper end surface, the left side surface and the lower end surface, and
wherein the spool is capable of being inserted in the base mold from the opening portion toward the back surface to be placed in the base mold.

2. The electromagnetic relay according to claim 1,
wherein the insulating member is formed to have a concave shape that extends along an outer peripheral of an upper end surface or a lower end surface of the spool.

3. The electromagnetic relay according to claim 1, further comprising a bottom plate that covers a bottom surface of the yoke.

4. The electromagnetic relay according to claim 3, wherein an adhesive agent is coated at the bottom surface of the yoke.

5. The electromagnetic relay according to claim 1, wherein when the spool is placed in the base mold, the back surface is provided between the yoke and the spool.

6. An electromagnetic relay comprising:
a spool in which a coil is wound around its outer peripheral surface;
a contact portion that includes a fixed contact and a movable contact that contacts the fixed contact;
an armature that is operated to move the movable contact between a contacting position at which the fixed contact contacts the movable contact, and a non-contacting position at which the fixed contact and the movable contact are apart from each other;
a yoke arranged along the spool and is positioned between the spool and the contact portion; and
an insulating member that includes
a back surface positioned between the spool and the yoke,
an upper surface provided at an upper end of the back surface that covers an upper end of the spool,
a lower surface provided at a lower end of the back surface that covers a lower end of the spool, and
two side surfaces provided at each side of the back surface, respectively, each of the side surfaces covering a different side of the spool,
wherein an opening portion is provided at a side of the insulating member opposite to the back surface, and
wherein the spool is capable of being inserted in the insulating member form the opening portion toward the back surface.

* * * * *